United States Patent [19]

Fujisawa et al.

[11] 4,344,538

[45] Aug. 17, 1982

[54] CYCLONE SEPARATOR WITH INFLUENT GUIDE BLADE

[75] Inventors: Tetsuo Fujisawa, Kobe; Takashi Tanioka, Osaka, both of Japan

[73] Assignee: Kabushiki Kaisha Kobe Seiko Sho, Kobe, Japan

[21] Appl. No.: 266,176

[22] Filed: May 22, 1981

[30] Foreign Application Priority Data

Jun. 11, 1980 [JP] Japan ..... 55-82184[U]
Jul. 16, 1980 [JP] Japan ..... 55-98123

[51] Int. Cl.[3] ..... B04C 5/04; B04C 5/103

[52] U.S. Cl. ..... 209/144; 55/418; 55/459 R

[58] Field of Search ..... 209/144, 211; 55/459 R, 55/459 D, 418

[56] References Cited

U.S. PATENT DOCUMENTS

| | | | |
|---|---|---|---|
| 926,206 | 6/1909 | Morse | 55/459 R X |
| 2,616,563 | 11/1952 | Hebb | 55/459 R X |
| 3,513,642 | 5/1970 | Cornett | 55/459 D X |
| 3,953,184 | 4/1976 | Stockford et al. | 55/459 D X |

FOREIGN PATENT DOCUMENTS

| | | | |
|---|---|---|---|
| 628622 | 7/1927 | France | 209/144 |
| 529692 | 11/1940 | United Kingdom | 209/144 |

OTHER PUBLICATIONS

Publication No. 1 - -transportation of granular particles (Funryutai no Kuukiyuso); Published By: Nikkan Kogyo Shinbunsha; Jan. 1979, third edition.

Publication No. 2 -Crushing No. 14 (Funsai 14 Go); Published By: Kabushiki Kaisha Fosokawa; Aug. 1966.

Publication No. 3 -Memoirs of the Faculty of Engineering, Nagoya Univ.; Sep. 1953, Note: This is a doctoral thesis.

*Primary Examiner*—Ralph J. Hill

*Attorney, Agent, or Firm*—Oblon, Fisher, Spivak, McClelland & Maier

[57] ABSTRACT

A cyclone separator with an influent guide blade at the inlet thereof, the guide blade being so shaped and positioned so as to suppress the pressure loss of the cyclone while at the same time improving its separation efficiency. The influent guide blade has a width of 0.1 to 0.5 in dimensional ratio to the radius of the straight cylindrical portion of the cyclone and is located at a position lower than the ceiling wall surface of an inlet duct by a distance of 0.05 to 0.5 in dimensional ratio to the height of the inlet duct.

4 Claims, 11 Drawing Figures

CYCLONE SEPARATOR WITH INFLUENT GUIDE BLADE

BACKGROUND OF THE INVENTION:

1. Field of the Invention

This invention relates to cyclone separators, and more particularly to cyclone separators with influent guide blades.

2. Description of The Prior Art:

Cyclone separators are used for various purposes, for instance, for centrifugally separating or collecting solid particles of foreign matter from a fluid by whirling them in vortexes of the fluid, for classifying solid particles in a fluid according to the mass scales of the individual particles, or for effecting heat exchange between a solid and a gas by contacting them with each other or during separation thereof. The cyclones are used independently or in combination with other equipment depending upon the purposes for which they are intended to serve, including:

(a) A separator used at the terminal end of a pneumatic particle transfer line.

(b) A separator used at the terminal end of a drifted air-drying line for coal or the like.

(c) A cyclone separator used in a closed-circuit type pulverizing equipment for various ores or other raw materials.

(d) A heat exchanger for preheating raw cement powder, aluminum hydroxide powder or powdery limestone or other material prior to calcining.

There have thus far been made various studies with objectives of reducing the pressure losses and improving the separation efficiency in the cyclone separators of the above-mentioned classes. However, these objectives are contrastively related with each other since there is a general tendency that a cyclone separator with a small pressure loss is low in separation efficiency or vice versa. Among the known cyclone constructions, the cyclone separator which has an influent guide blade at an inlet duct is regarded as having a relatively high separation efficiency in spite of its low pressure loss although not satisfactorily high enough. The pressure loss and collecting efficiency by a cyclone separator of a standard or plain construction have been explained to a practical extent by theoretical analysis. However, no sufficient analysis has ever been made of the behaviors of fluid flows within a cyclone of a special construction like a cyclone with an influent guide blade. Referring to the accompanying drawings and first to FIGS. 1 and 2, there is shown a conventional cyclone of the standard type which is not provided with an influent guide blade. the cyclone has a straight cylindrical portion 1 and an inverted conical portion 2 which is formed contiguously below the straight cylindrical portion 1 and has a downwardly reducing sectional area twoard an outlet 3, which is provided at its lower end for the withdrawal of separated solid foreign material. The upper end of cylindrical portion 1 is closed with a ceiling wall 4 which is centrally provided with an opening to receive the lower end portion of an exhaust duct 5 in upper cylindrical portion 1. An inlet duct 6 is tangentially or circumferentially connected to the upper end of straight cylindrical portion 1 to feed a fluid containing solid particles to be separated or classified. The influent of mixed phase is whirled between exhaust duct 5 and the inner wall surface of straight cylindrical portion 1 to form a vortex 8 which is gradually lowered and finally reversed at the converged lower end of the conical portion to form a central axial flow, leaving the cyclone through exhaust duct 5. On the other hand, the solid particles in vortex 8 are separated or classified under the influence of the centrifugal force toward and along the inner wall surfaces of the straight cylindrical portion and lower conical portion 2 for discharge through outlet 3.

This type of cyclone suffers from not only an insufficient separation efficiency but also a large pressure loss of the fluid, requiring employment of a suction blower of a large capacity. Therefore, there has been a strong demand for the improvement of the separation efficiency and the reduction of the pressure loss. The large pressure loss in the above-described cyclone is considered to occur for the following reason. As indicated by arrows in FIGS. 1 and 2, the fluid which has been whirled around exhaust duct 5 is impinged obliquely against the fresh influent fluid from inlet duct 6, pushing the influent fluid toward the inner peripheral wall of the cyclone to cause "contracted flow". As a result, the velocity of flow on the inner peripheral wall of the straight cylindrical portion is increased as compared with that of the influent fluid in inlet duct 6, increasing the pressure loss due to friction against the inner peripheral wall of the cylindrical portion.

FIGS. 3 and 4 illustrate a convention cyclone separator with an influent guide blade. More particularly, the cyclone is provided with an influent guide blade 10 which is projected on the extension of and at the same height as the inner side wall of the inlet duct. As shown in FIG. 4, the influent fluid which has been admitted through inlet duct 6 and whirled around the lower end of exhaust duct 5 is impinged against influent guide blade 10 and thereby directed in a direction substantially parallel with the fresh influent fluid. The provision of the inlet guide blade thus prevents the occurrence of contracted flow and the increase of the flow velocity on the inner peripheral wall is increased due to the contracted flow as shown in FIG. 1, the pressure loss is increased due to the increased number of revolutions of the fluid. In this regard, influent guide blade 10 also contributes to reduce the number of revolutions of thefluid and hence the pressure loss.

Thus, the influent guide blade 10 has a function of effectively reducing the pressure loss but has a problem in that the separation efficiency of solid particies is sacrificed. Namely, the conventional inlet guide blade fails to provide a perfect improvement.

Under these circumstances, the present invention is directed to improving both the pressure loss and separation efficiency by an extensive study on their relation with the shape, dimensions and mounting position of the influent guide blade.

SUMMARY OF THE INVENTION:

With the foregoing in view, the present inventors conducted an extensive study in an attempt to provide a cyclone separator with an influent guide blade which would satisfy both of the above-mentioned two objectives. As a result, we have found that the two objectives can be achieved by suitably locating an inlet guide blade of particular dimensions and shape at the inlet of the cyclone separator.

According to a first embodiment of the present invention, there is provided a cyclone separator for separating or collecting solid particles from a fluid, including a vertically disposed straight cylindrical portion having an inlet duct for introducing thereinto a fluid in a circumferential or tangential direction and receiving an exhaust duct centrally through a top or ceiling wall thereof, and a separating portion of inverted conical shape formed contiguously below the straight cylindrical portion and having an outlet for separated solid particles at the converged bottom therof, the cyclone including: an influent guide blade projected into the straight cylindrical portion along an extension line of the inner side wall of the inlet duct and having a width of 0.1 of 0.5 in dimensional ratio to the radius of the straight cylindrical portion, the upper end of the influent guide blade being located at a position lower than the ceiling wall surface of the inlet duct by a distance of 0.05 to 0.5 in dimensional ratio to the height of the inlet duct.

According to a second embodiment of the present invention, the influent guide blade is projected into the straight cylindrical portion of the cyclone substantially along an extension line of the inner side wall of the inlet duct and has a width of 0.1 to 0.5 in a dimensional ratio to the radius of the straight cylindrical portion, the lower end of the influent guide blade being in a position located at the distance of at least 1.1 in a dimensional ratio to the height of the inlet duct without being extended beyond the lower end of the straight cylindrical portion.

BRIEF DESCRIPTION OF THE DRAWINGS:

Various other objects, features and attendant advantages of the present invention will be more fully appreciated as the same becomes better understood from the following detailed description when considered in connection with the accompanying drawings in which like reference characters designate like or corresponding parts through the several views and wherein.

DETAILED DESCRIPTION OF THE INVENTION

Figure 2:
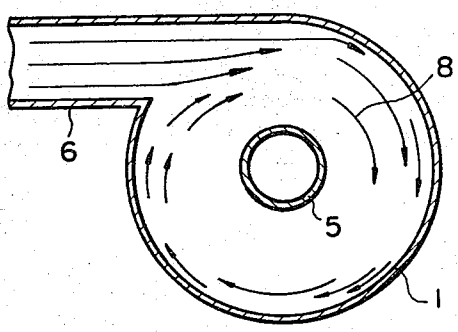
FIG. 2 PRIOR ART
FIG. 2 is a transverse section of the cyclone of FIG. 1.
Figure 6:
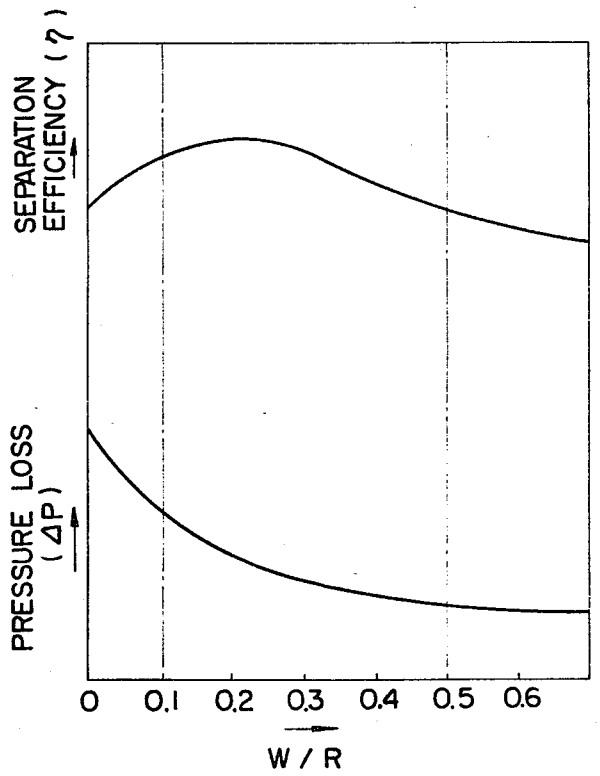
FIG. 6 is a graphic illustration of the relation of a dimensional ratio W/R with the separation efficiency and pressure loss.
Figure 5:
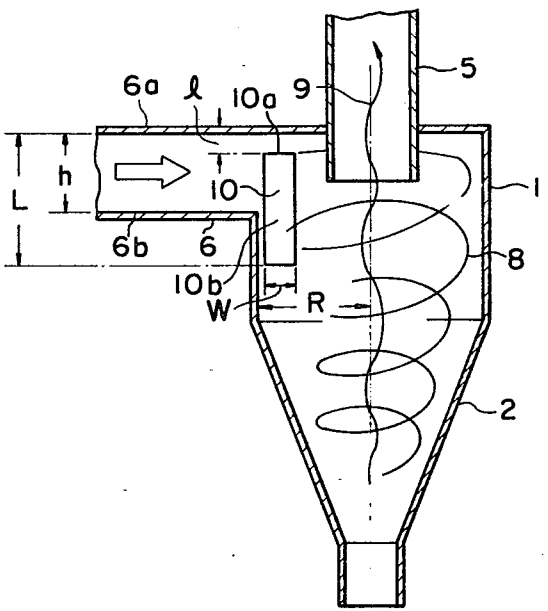
FIG. 5 is a longitudinal section of a cyclone according to the present invention.

Referring now to the drawings,

FIG. 5 depicts an embodiment of the present invention, in which a dimensional ratio W/R, a ratio of the width W of the inlet guide blade to the radius R of the straight cylindrical portion of the cyclone, is in the relation shown in the graph of FIG. 6. As seen therefrom, the pressure loss abruptly decreases with increases in W/R and is maintained substantially at a constant level with a ratio W/R in excess of about 0.5. On the other hand, the separation efficiency is initially enhanced with increases in W/R and then gradually drops after a peak at a dimensional ratio W/R of about 0.1–0.3. Although the relation of W/R with the separation efficiency $\eta$ and the pressure loss $\Delta P$ of the cylone is influenced by the shape of the cyclone, the length of the inserted lower end of the exhaust duct and the shape of the influent guide blade, it is possible to secure a high separation efficiency and simultaneously to suppress the pressure loss to a minimum by setting the value of W/R at 0.1 to 0.5.

Figure 7:
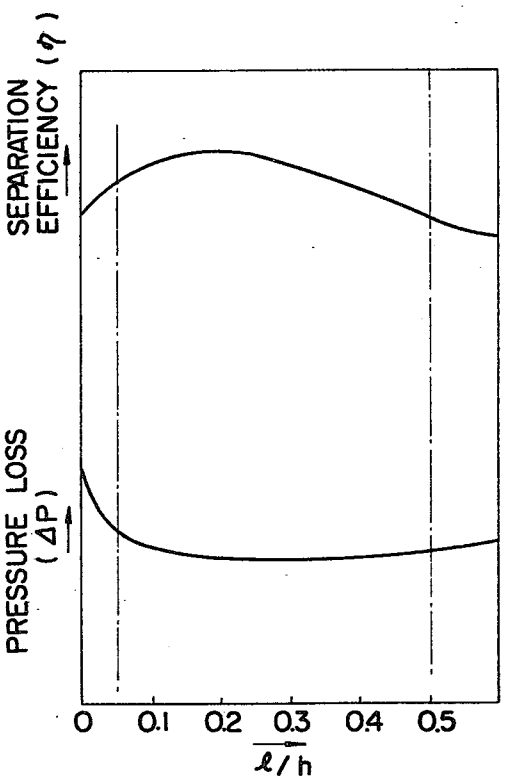
FIG. 7 is a graphic illustration of the relation of a dimensional ratio l/h with the separation efficiency and pressure loss.

Referring to FIG. 5, experiments were conducted to study the influence on the pressure loss and the separation efficiency of a dimensional ratio of l/h, a ratio of the distance l between the upper end 10*a* of influent guide blade 10 and ceiling wall surface 6*a* of the inlet duct 6 to the height h of the inlet duct 6. The results are shown in FIG. 7 which reveal the completely new fact that there is a tendency of the pressure loss being reduced simultaneously with enhancement of the separation efficiency when the value of l/h is increased gradually from zero (the condition of the prior art where upper end 10*a* of the influent guide blade is at the level of ceiling wall surface 6*a* of the inlet duct), that is to say, when upper end 10*a* is lowered away from ceiling wall surface 6*a* of the inlet duct. As clear from FIG. 7, the pressure loss is sharply reduced toward a dimensional ration l/h of about 0.05 and maintained at the reduced level until a ratio of about 0.5 is reached. On the other hand, the separation efficiency is enhanced along with increases in the ratio l/h and gradually lowered after a peak in the vicinity of a dimensional ratio of about 0.1–0.3. With a dimensional ratio l/h in excess of about 0.5, the separation efficiency is dropped to a level even lower than initial level where the dimensional ratio l/h is zero. The relation of the dimensional ratio l/h with the separation efficiency $\eta$ and pressure loss $\Delta P$ of the cyclone is influenced by the shape of the cyclone, the inserted length of the exhaust duct in the cyclone and the width W of the influent guide blade. However, it has been found that a high separation efficiency can be secured while supressing the pressure loss to a minimum, by having the dimensional ratio l/h in the range of 0.05–0.5, preferably in the range of 0.1–0.3.

Figure 8:
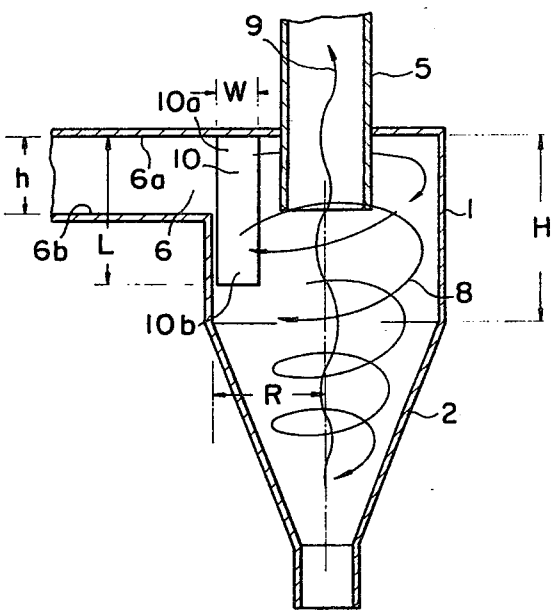
FIG. 8 is a diagrammatic longitudinal section of another embodiment of the present invention.

FIG. 8 illustrates an embodiment in which the influent guide blade has its lower end extended to a lever lower than bottom surface 6*b* of the inlet duct thereby to simultaneously improve the pressure loss and the separation efficiency.

Figure 9:
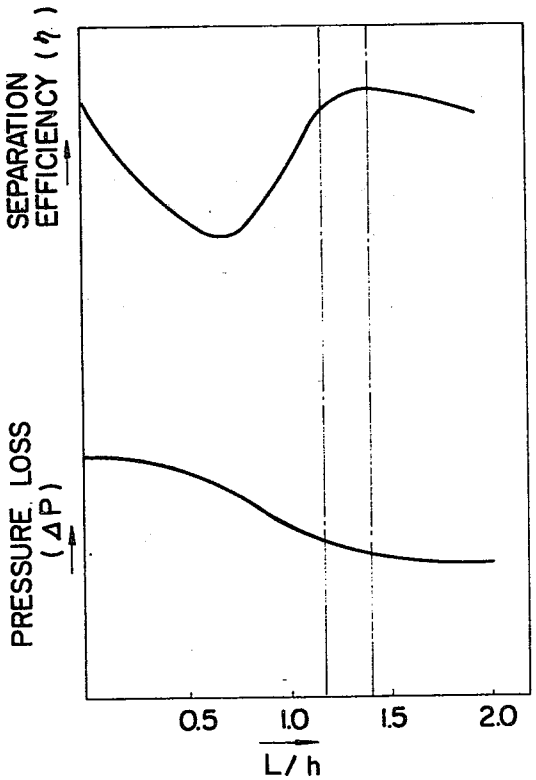
FIG. 9 is a graphic illustration of the relation of a dimensional ratio L/h with the separation efficiency and pressure loss.

FIG. 9 shows the results of experiments directed to the influence of L/h, a ratio of the height L of influent guide blade 10 to the height h of the inlet duct 6 on the pressure loss and the separation efficiency, using a cyclone of $H/h \approx 1.4$, a ratio of the height H of straight cylindrical portion 1 to the height h of inlet duct 6. As clear from FIG. 9, the pressure loss is reduced with increases in the ratio L/h while the separation efficiency is sharply lowered up to a ratio L/h of about 0.7 but it is increased as the lower end of the influent guide blade is extended below the level of the bottom surface of inlet duct 6 ($L/h > 1.0$), showing at the ratio of about 1.2–1.4 a separation efficiency comparable to that where the height ratio of L/h is zero. The separation efficiency is lowered again in a case where the lower end portion of the influent guide blade is extended as far as the inverted conical portion of the cyclone ($l/h > 1.4$). These results show that it is possible to suppress the pressure loss to a minimum while guaranteeing a high separation efficiency, by setting the ratio L/h at a value grater than 1.2 and smaller than 1.4 (=H/h).

The relation of the ratio L/h with the separation efficiency $\eta$ and the pressure loss $\Delta P$ is influenced by the shape of the cyclone, the length of the inserted lower end portion of the exhaust duct in the cyclone, the width W of the inlet guide blade and the distance l between the upper end of the influent guide blade and the ceiling wall of the inlet duct. However, the pressure loss can be suppressed to a minumum and a high separation efficiency is ensured by setting the ratio L/h at a value greater than 1.1 and extending the lower end 10*b* of the influent guide blade downwardly to a point short of the lower end of the straight cylindrical portion 1 (or the joint portion between the straight cylindrical portion 1 and the inverted conical portion 2). More preferably, upper end 10*a* of the influent guide blade is located at a level lower than the ceiling wall surface 6*a* of inlet duct 6.

Figure 10:
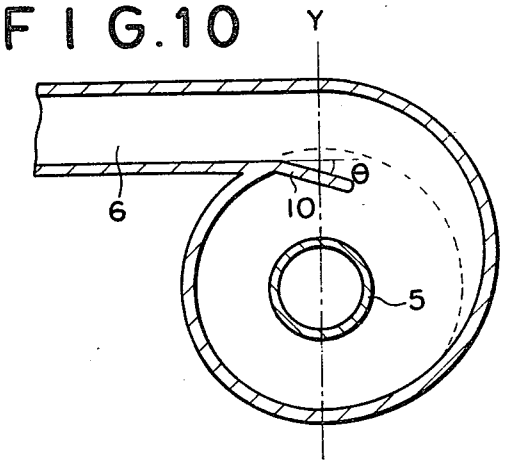
FIGS. 10 and 11 are transverse sections showing further embodiments of the present invention.
Figure 11:
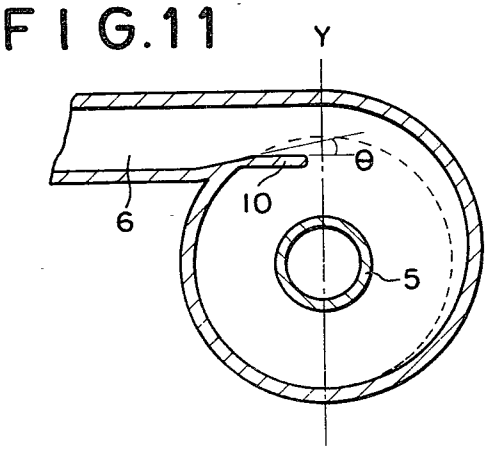

In some case, the influent guide blade is projected inwardly along the extension of the inner side wall of the inlet duct to a point beyond the center line Y of the cyclone which is disposed perpendicular to the longitudinal center line of the inlet duct as shown in FIG. 10, or the inner side wall of the inlet duct is turned outward at the inlet of the cyclone as shown in FIG. 11. In these cases, it is preferred to divert the inlet guide blade toward the center of the cyclone so that a fluid induction passage of a uniform or increasing width is formed contiguously to the inlet duct and between the inlet guide blade and the inner peripheral wall of the cyclone, since otherwise the fluid induction passage becomes narrower than the duct at the inlet of the cyclone, increasing the pressure loss due to the higher flow velocity of the influent fluid. Thus, the provision of a fluid induction passage of a uniform or increasing width suppresses the increase of the pressure loss. However, the width of the fluid induction passage may be narrowed slightly at the projected inner end of the inlet guide blade depending upon the purpose of operation for which the cyclone is intended to serve, for example, in a case where a higher separation efficiency is desired in spite of an increase in the pressure loss.

It is possible to make various modifications or alterations to the above-described embodiments of the present invention. For instance, although influent guide blade 10 is generally attached to the inner end of inlet duct 6, it may be mounted on exhaust duct 5 by the use of a bracket. For a cyclone which is intended for operation at a high temperature, it is desirable to provide a lining of a refractor heat-insulating material on the inner wall surfaces of the cyclone and to form the influent guide blade from a heat-resistant steel.

Figure 1:
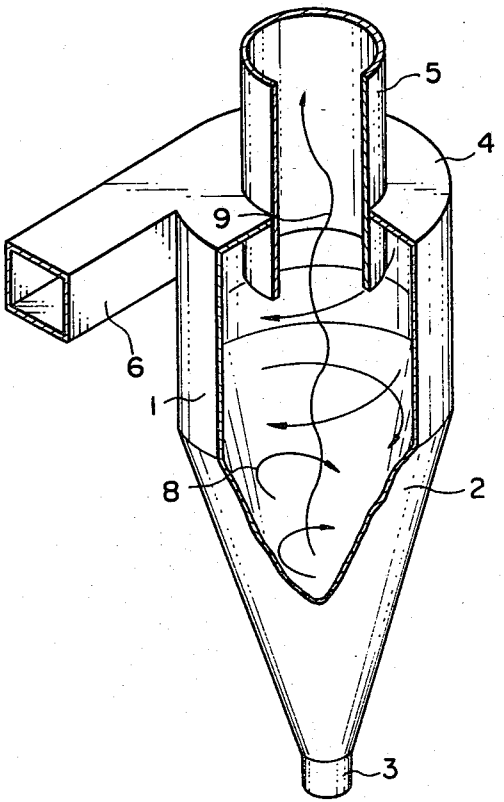
FIG. 1 PRIOR ART
FIG. 1 is a partly sectioned diagrammatic view of a conventional cyclone of a standard or plain construction which is not provided with an influent guide blade.
Figure 4:
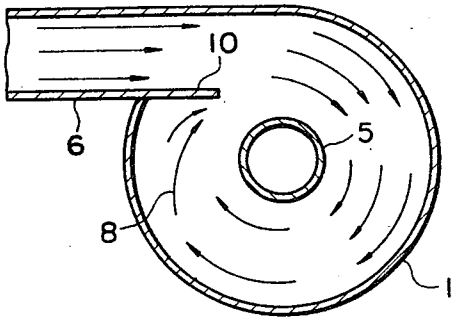
FIG. 4 PRIOR ART
FIG. 4 is a transverse section of the cyclone of FIG. 3.
Figure 3:
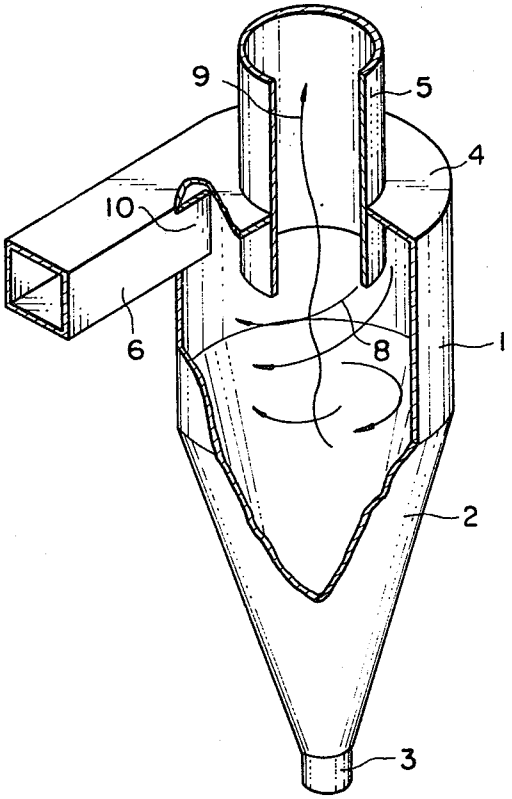
FIG. 3 PRIOR ART
FIG. 3 is a partly sectioned diagrammatic view of a conventional cyclne with an influent guide blade.

The following experimental example more particularly illustrates the effects of the embodiment of the invention shown in FIG. 5, in comparison with the conventional cyclone constructions of FIGS. 1 and 3.

EXPERIMENTAL EXAMPLE:

The pressure loss and separation efficiency were measured with use of a cyclone of the construction shown in FIG. 1 and having the dimensions of 150 mm in the radius R of the straight cylindrical portion, 225 mm in the height of the straight cyclindrical portion and 165 mm in the height h of the inlet duct, for each of the cases where (1) the cyclone is provided with no influent guide blade (FIG. 1), (2) the cyclone is provided an influent guide blade the upper end of which is located level with the ceiling wall surface of the inlet duct ($l/h=0$) and which has a length equivalent to the height of the inlet duct ($L/h=1$) (FIG. 3), and (3) the cyclone is provided with an influent guide blade the upper end of which is located 35 mm below the ceiling wall surface of the inlet duct ($l/h=35/165\approx0.2$) and which has a height (the dimension from the ceiling wall surface of the inlet duct to the lower end of the guide blade) of 200 mm ($l/h\approx1.2$) (FIG. 5). In all cases, the width W of the guide blade was 40 mm ($W/R\approx0.27$), and powder of a commercially available cement was blown into the cyclone at a feed rate of 20 kg/min along with dried air at a velocity of 18 m/sec in the inlet duct.

The results are shown in Table 1 below.

TABLE 1

| Experiment No. | Pressure loss (mmAq) | Separation efficiency (%) |
|---|---|---|
| (1) Plain cyclone | 100 | 93.0 |
| (2) Cyclone with conventional guide blade | 70 | 91.5 |
| (3) Cyclone of invention | 55 | 94.0 |

As is clear from Table 1, the conventional plain cyclone is high in separation efficiency but involves a large pressure loss. The cyclone with the conventional guide blade is capable of suppressing the pressure loss to a certain extent but only at the sacrifice of the separation efficiency. In contrast, the cyclone of the present invention reduces the pressure loss to about one half of the plain cyclone while maintaining a separation efficiency even higher than in the conventional plain cyclone.

It will be appreciated from the foregoing description that the cyclone of the present invention which simultaneously realizes the reduction of pressure loss and the enhancement of the separation efficiency contributes to energy-saving operations and has a great value as a mechanism for separating, collecting or classifying powder or particulate material or as a heat-exchanging mechanism.

Obviously, numerous modifications and variations of the present invention are possible in light of the above teachings, it is therefore to be understood that within the scope of the appended claims, the invention may be practiced otherwise than as specifically described herein.

What is claimed is:

1. A cyclone separator for separating or collecting solid particles from a fluid, comprising:

a vertically disposed straight cylindrical portion having an inlet duct for introducing thereinto a fluid in a circumferential or tangential direction and receiving an exhaust duct through the top or ceiling wall thereof;

a separating portion of inverted conical shape formed contiguously below the straight cylindrical portion and having an outlet for separated particles at the converged bottom thereof; and an influent guide blade projected into said straight cylindrical portion of said cyclone along an extension line of the inner side wall of said inlet duct and having a width of 0.1 to 0.5 in dimensional ratio to the radius of said straight cylindrical portion, the upper end of said influent guide blade being located at a position lower than the ceiling wall surface of said inlet duct by a distance of 0.05 to 0.5 in dimensional ratio to the height of said inlet duct.

2. A cyclone separator as set forth in claim 1, wherein the upper end of said influent guide blade is located at a position lower than the ceiling wall surface of said inlet duct by a distance of 0.1 to 0.3 in dimensional ratio to the height of said inlet duct.

3. A cyclone separator for separating or collecting solid particles from a fluid, comprising:

a vertical disposed cylindrical portion having an inlet duct for introducing thereinto a fluid in a circumferential or tangential direction and receiving an exhaust duct centrally through a top or ceiling wall thereof;

a separating portion of inverted conical shape formed contiguously below the straight cylindrical portion having a height of at least 1.1 times greater than that of said inlet duct; and an influent guide blade projected into said straight cylindrical portion of said cylone substantially along an extension line of the inner side wall of said inlet duct and having width of 0.1 to 0.5 in dimensional ratio to the radius of said straight cylindrical portion, said influent guide blade having the lower end thereof located at a distance of at least 1.1 in dimensional ratio to the height of said inlet duct without being extended beyond the lower end of said straight cylindrical portion.

4. A cyclone separator as set forth in claim 1, 2 or 3, wherein said influent guide blade is diverted toward the center of said cyclone to form a fluid induction passage of a width substantially the same as or diverging away from said inlet duct in plan view.

* * * * *

UNITED STATES PATENT AND TRADEMARK OFFICE

CERTIFICATE OF CORRECTION

PATENT NO. : 4,344,538

DATED : August 17,1982

INVENTOR(S) : Fujisawa et al.

It is certified that error appears in the above—identified patent and that said Letters Patent is hereby corrected as shown below:

Column 1, line 56, change "twoard" to --toward--.

Column 2, line 27, change "convention" to --conventional--.

Column 2, line 40, change "FIG. 1" to --FIG. 2--.

Column 2, line 47, change "particies" to --particles--.

Column 3, line 7, change "therof" to --thereof--.

Column 3, line 43, change "cyclne" to --cyclone--.

Column 4, line 9, change "cylone" to --cyclone--.

Column 4, line 20 delete "the".

Column 4, line 21, delete "the" (second occurrence).

Column 4, line 56, delete "the" (second occurrence).

Column 4, line 50, change "lever" to --level--.

Column 5, line 3, change "(1/h" to --(L/h--.

UNITED STATES PATENT AND TRADEMARK OFFICE

CERTIFICATE OF CORRECTION

PATENT NO. : 4,344,538 Page 2 of 2

DATED : August 17, 1982

INVENTOR(S) : Fujisawa et al.

It is certified that error appears in the above—identified patent and that said Letters Patent is hereby corrected as shown below:

Column 5, line 6, change "grater" to --greater--.

Column 5, line 14, change "minumum" to --minimum--.

Column 5, line 55, change "refractor" to --refractory--.

Column 7, line 13, change "vertical" to --vertically--.

Column 8, line 4, change "cylone" to --cyclone--.

Signed and Sealed this

Third Day of May 1983

[SEAL]

*Attest:*

GERALD J. MOSSINGHOFF

*Attesting Officer* *Commissioner of Patents and Trademarks*